US008259978B2

(12) United States Patent
Chiu

(10) Patent No.: US 8,259,978 B2
(45) Date of Patent: Sep. 4, 2012

(54) SOUND BOX AND PORTABLE ELECTRONIC DEVICE USING THE SAME

(75) Inventor: Peng-Yu Chiu, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 835 days.

(21) Appl. No.: 12/327,449

(22) Filed: Dec. 3, 2008

(65) Prior Publication Data

US 2009/0296970 A1 Dec. 3, 2009

(30) Foreign Application Priority Data

May 30, 2008 (CN) ..... 2008 1 0301877

(51) Int. Cl.
*H04R 9/06* (2006.01)

(52) U.S. Cl. ..... 381/332; 381/334

(58) Field of Classification Search ..... 381/332, 381/334

See application file for complete search history.

(56) References Cited

U.S. PATENT DOCUMENTS 1,546,924 A * 7/1925 Forse ..... 369/157
7,162,048 B2 * 1/2007 Shima ..... 381/334

OTHER PUBLICATIONS

Loudspeaker, p. 4. , Wikipedia.*

* cited by examiner

*Primary Examiner* — Ramon Barrera
(74) *Attorney, Agent, or Firm* — Altis Law Group, Inc.

(57) ABSTRACT

A sound box (10) accommodating a loud speaker (20) mounted in a housing (30) of electronic device (100) is described. The sound box (10) comprises a metal element (12) and a rubber element (14). The metal element (12) defines a receiving space (123) for accommodating the louder speaker (20), and the metal element (12) has a planar wall (122) surrounding the receiving space (123). The rubber element (14) can be formed with the planar wall (122).

14 Claims, 4 Drawing Sheets

SOUND BOX AND PORTABLE ELECTRONIC DEVICE USING THE SAME

BACKGROUND

1. Field of the Invention

The exemplary invention relates to sound boxes and, particularly to sound boxes for portable electronic devices.

2. Description of Related Art

Multi-function portable electronic devices have been widely used. Generally, the portable electronic device has a loudspeaker for implementing the multi-media playing function, and the loudspeaker is commonly received in a sound box of the portable electronic device.

However, the sound box is commonly made of plastic material, and as the rigidity of the plastic material is low. The thickness of the sound box needs to be increased for enhancing the structural strength of the sound box. As a result, the size of the sound box is decreased, thus affecting the tone quality of the loud speaker.

Therefore, there is room for improvement within the art.

BRIEF DESCRIPTION OF THE DRAWINGS

Many aspects of the exemplary sound box and the portable electronic device using the sound box can be better understood with reference to the following drawings. These drawings are not necessarily drawn to scale, the emphasis instead being placed upon clearly illustrating the principles of the exemplary sound box. Moreover, in the drawings like reference numerals designate corresponding parts throughout the several views. Wherever possible, the same reference numbers are used throughout the drawings to refer to the same or like elements of an embodiment.

DETAILED DESCRIPTION OF THE EMBODIMENTS

Figure 1:
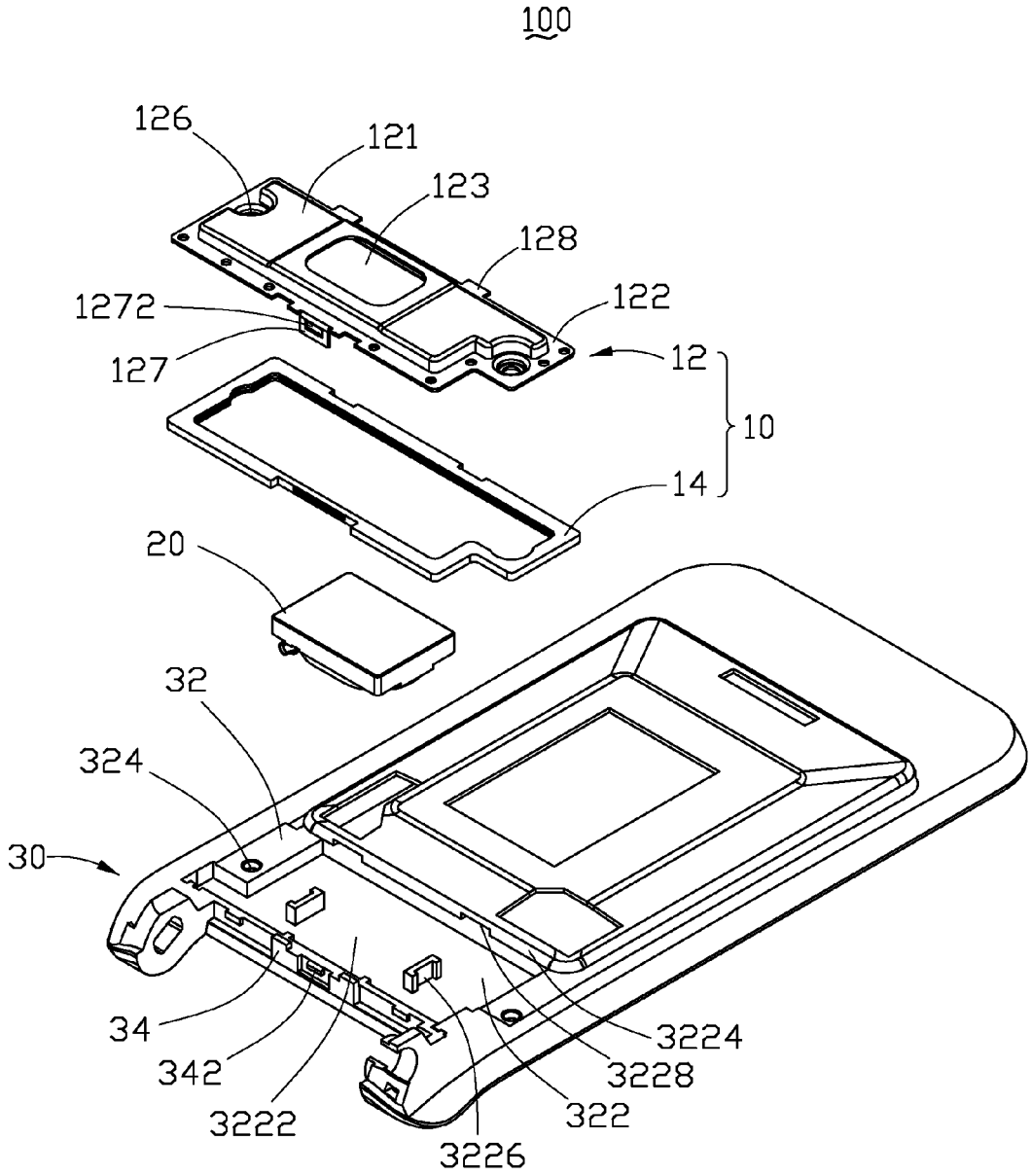
FIG. 1 is an exploded view of a portion of a portable electronic device using a sound box according to an exemplary embodiment.

Referring to FIG. 1, a portion of the portable electronic device in the form of a mobile phone 100 includes a housing 30, a sound box 10 mounted to the housing 30, and a loudspeaker 20 partly accommodated in the sound box 10.

The sound box 10 includes a metal element 12 and a rubber element 14 mounted to the metal element 12. The metal element 12 may be made of aluminum or aluminum alloy, and the rubber element 14 may be made of polybutadiene or propyl cyanide.

The metal element 12 is configured for accommodating the loud speaker 20 therein and is generally a semi-enclosed shell with a raised section 121 and a planar wall 122. The raised section 121 and the planar wall 122 cooperatively define a receiving space 123 for accommodating the loud speaker 20, and the planar wall 122 surrounds the receiving space 123.

The metal element 12 has two holes 126 defined in the planar wall 122 adjacent to two opposite ends of the metal element 12. The holes 126 are for engaging with the housing 30. A side of the metal element 12 has a latching portion 127, may be a latching sheet, and another side has two securing portions 128 in the form of two projections for engaging with the housing 30. The center of the latching portion 127 defines an aperture 1272 for securing the metal element 12 to the housing 30.

Figure 4:
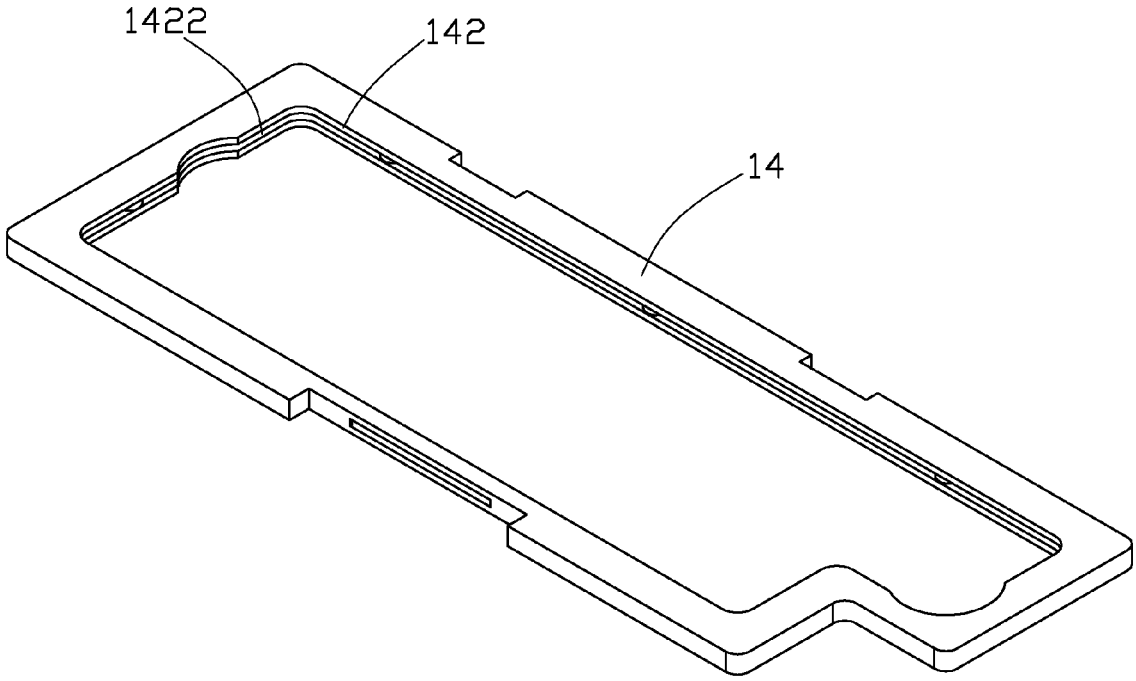
FIG. 4 is a partially enlarged view of a rubber element of the portable electronic device in FIG. 1.

Referring to FIG. 4, the rubber element 14 is a ring body and has the same shape as the planar wall 122. The rubber element 14 has an inner wall 142 and has a slot 1422 defined in the inner wall 142 for accommodating the planar wall 122 therein. The rubber element 14 may be manufactured separately and then engage with the planar wall 122, or may be integrally formed with planar wall 122.

The housing 30 includes a front wall 32 facing the sound box 10 and a first sidewall 34 located adjacent to the front wall 32. The front wall 32 defines a cavity 322 corresponding to the sound box 10 and the cavity 322 communicates with the first sidewall 34. A bottom wall 3222 and a second sidewall 3224 located opposite to the first side wall 34 are formed in the cavity 322 of the housing 30. The bottom wall 3222 has two securing posts 3226 protruding therefrom and located opposite to each other. A distance between the two securing posts 3226 corresponds to the length of the loudspeaker 20 so the loudspeaker 20 can be securely held between the two securing posts 3226. The second sidewall 3224 defines two slots 3228 corresponding to the securing portions 128. The securing portions 128 are for latching with the slots 3228.

Figure 3:
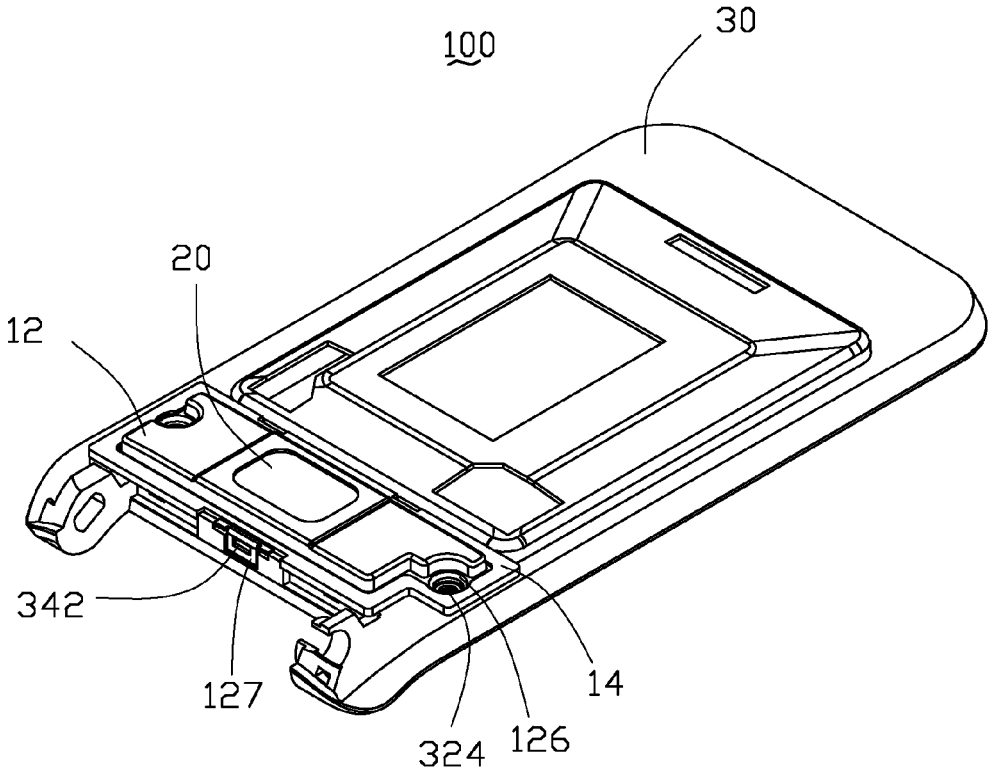
FIG. 3 is an assembled view of the portion of the portable electronic device in FIG. 1.

Referring to FIG. 3, the front wall 32 has two screw holes 324 defined therein. The screw holes 324 align with the holes 126 when the sound box 10 is positioned to be mounted to the housing 30. The first sidewall 34 has a hook 342 for engaging the aperture 1272.

Figure 2:
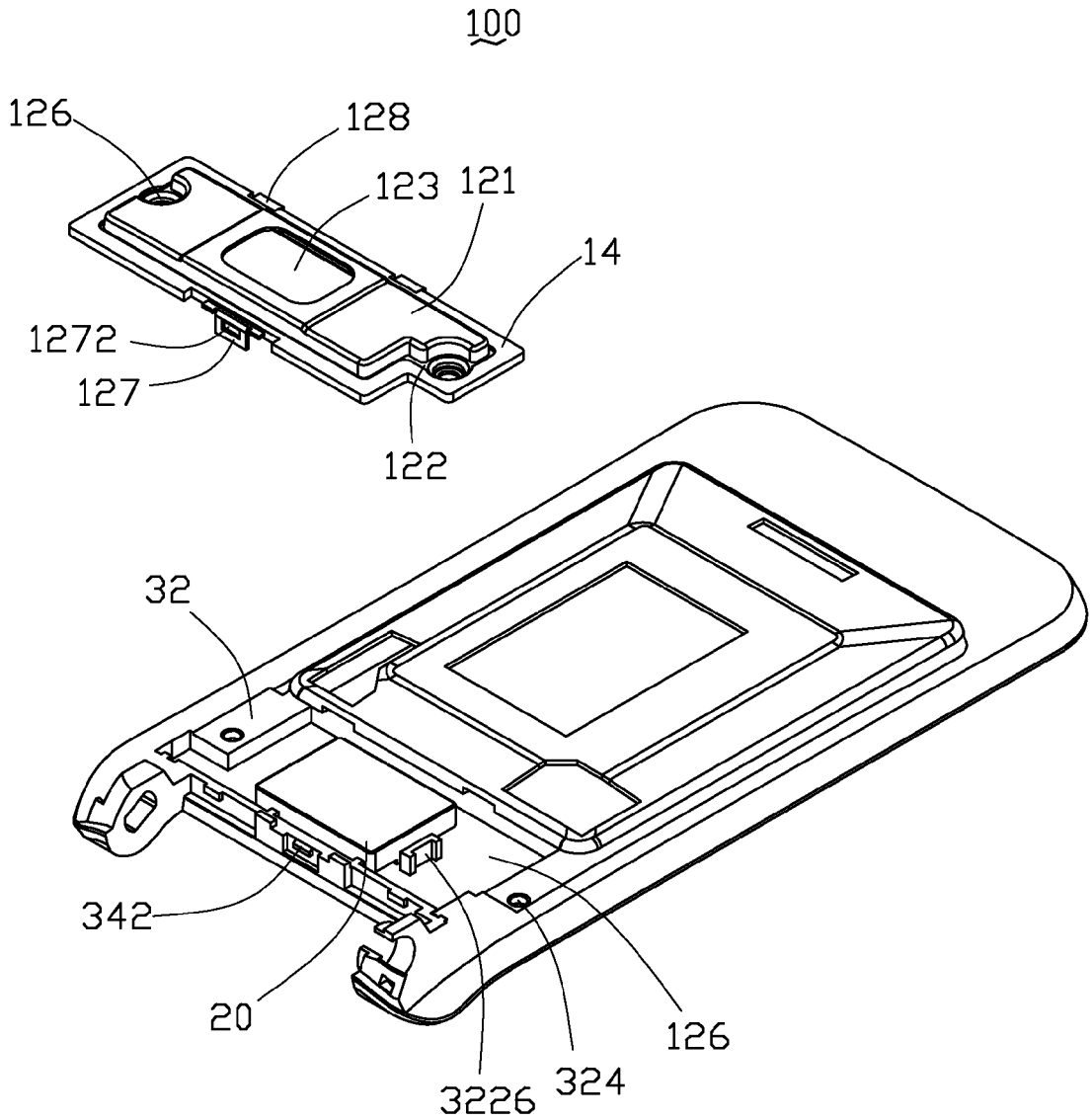
FIG. 2 is an assembled view of the sound box, and the loud speaker assembled to the housing in FIG. 1.

Referring to FIGS. 2 and 3, when assembling the mobile phone 100, the loudspeaker 20 is positioned and securely held between the two securing posts 3226, at this time, part of the loud-speaker 20 is accommodated in the cavity 322. After that, the sound box 10 is mounted to the housing 30. During this stage, another part of the loud-speaker 20 is accommodated in the receiving space 123 of the sound box 10, the holes 126 are aligned with the screw holes 324, the securing portions 128 are latched with the slots 3228, and the hook 342 is inserted into and hooked with the aperture 1272. Two screws (not shown) are inserted through the holes 126 and then screw into the screw holes 324, to tightly engage the sound box 10 to the housing 30.

Because the sound box 10 is made of metal material, having a higher rigidity than plastic material, the thickness of the sound box 10 can be decreased while still achieving the required structural strength of the sound box 10. As a result, the size of the sound box 10 is increased, thus improving the tone quality of the loud speaker 20.

Additionally, as the flatness of the metal material is superior to the plastic material, and the rubber element 14 formed on the planar wall 122 enhances the engagement (e.g. without leakage of sounds) of the sound box 10 and the housing 30, the tone quality of the loud speaker 20 is further improved. Additionally, a metal sound box 10 can better shield the loud speaker 20.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sound box for accommodating a loud speaker, comprising:

a housing;

a metal element mounted to the housing, the metal element defining a receiving space for accommodating the loud speaker, the metal element having a planar wall surrounding the receiving space; and a rubber element located between the planar wall and the housing, to enhance an engagement of the metal element and the housing;

wherein a latching portion protrudes from one side of the metal element, and an aperture is defined in the latching portion, the housing having a hook for latching with the aperture.

2. The sound box as claimed in claim 1, wherein the rubber element is a ring body and has an inner wall, and a ring slot defined in the inner wall for accommodating the planar wall.

3. The sound box as claimed in claim 1, wherein the metal element has a number of holes defined therein, the housing has a number of screw holes corresponding to the holes.

4. The sound box as claimed in claim 1, wherein another side of the metal element has a securing portion, the housing having a slot for latching with the securing portion.

5. The sound box as claimed in claim 1, wherein the rubber element is integrally molded with the metal element.

6. A portable electronic device, comprising:

a housing;

a loud speaker mounted in the housing;

a sound box including a metal element retained to the housing, the metal element defined a receiving space for accommodating the loud speaker, the metal element having a planar wall surrounding the receiving space; and a rubber element located between the planar wall and the housing, to enhance an engagement of the metal element and the housing;

wherein a latching portion protrudes from one side of the metal element, and an aperture is defined in the latching portion, the housing having a hook for latching with the aperture.

7. The portable electronic device as claimed in claim 6, wherein the rubber element is a ring body and has an inner wall, a chamfer defined in the inner wall for accommodating the planar wall.

8. The portable electronic device as claimed in claim 6, wherein the metal element has a number of holes defined therein, the housing has a number of screw holes corresponding to the holes.

9. The portable electronic device as claimed in claim 6, wherein another side of the metal element has a securing portion, the housing having a slot latching with the securing portion.

10. The portable electronic device as claimed in claim 6, wherein the rubber element is integrally molded with the metal element.

11. A portable electronic device, comprising:

a housing;

a loud speaker mounted in the housing;

a sound box including a metal element retained to the housing, the metal element defined a receiving space for accommodating the loud speaker, the metal element having a planar wall surrounding the receiving space; and a rubber element, wherein the rubber element is a ring body and has an inner wall, a chamfer is defined in the inner wall for accommodating the planar wall;

wherein a latching portion protrudes from one side of the metal element, and an aperture is defined in the latching portion, the housing having a hook for latching with the aperture.

12. The portable electronic device as claimed in claim 11, wherein the metal element has a number of holes defined therein, the housing has a number of screw holes corresponding to the holes.

13. The portable electronic device as claimed in claim 11, wherein another side of the metal element has a securing portion, the housing having a slot latching with the securing portion.

14. The portable electronic device as claimed in claim 11, wherein the rubber element is integrally molded with the metal element.

* * * * *